US005090916A

United States Patent [19]

Magnier

[11] Patent Number: 5,090,916

[45] Date of Patent: Feb. 25, 1992

[54] MALE CONNECTOR FOR TELEPHONE AND/OR DATA PROCESSING COMMUNICATIONS NETWORK

[75] Inventor: Bernard Magnier, Cadenet, France

[73] Assignee: Interconnection Informatique, Pertuis, France

[21] Appl. No.: 727,917

[22] Filed: Jul. 10, 1991

[30] Foreign Application Priority Data

Jul. 11, 1990 [FR] France ..... 90 08831

[51] Int. Cl.[5] ..... H01R 13/627

[52] U.S. Cl. ..... 439/352; 439/299; 439/676

[58] Field of Search ..... 439/352, 354, 445, 447, 439/299, 676

[56] References Cited

U.S. PATENT DOCUMENTS

| | | | |
|---|---|---|---|
| 4,647,726 | 3/1987 | Blum | 439/299 |
| 4,703,989 | 11/1987 | Price et al. | 439/676 |
| 4,711,511 | 12/1987 | Noorily | 439/352 |
| 4,828,510 | 5/1989 | Muzslay | 439/352 |

FOREIGN PATENT DOCUMENTS 0366556 2/1990 European Pat. Off. .

*Primary Examiner*—Larry I. Schwartz
*Assistant Examiner*—Hien D. Vu
*Attorney, Agent, or Firm*—Oblon, Spivak, McClelland, Maier & Neustadt

[57] ABSTRACT

The invention relates to a male connector for a telephone and/or data processing communications network. This connector has an insulating support (1), in which are embedded connecting terminals connected to lines of a connection cable (10). It also has a rigid elastic tongue (19) integral with the support (1) and inclined with respect thereto, permitting the locking of the male connector in the female connector, as a result of a shoulder (22) on said tongue. This connector is essentially characterized in that it also has a slide bolt (24) engaging beneath the tongue and connected to the cable (10), in order to release the tongue (19) when pulling takes place on the cable (10), when the male connector is inserted in the female connector.

3 Claims, 2 Drawing Sheets

MALE CONNECTOR FOR TELEPHONE AND/OR DATA PROCESSING COMMUNICATIONS NETWORK

BACKGROUND OF THE INVENTION

1. Field of the Invention

The present invention relates to a male connector for a telephone and/or data processing communications network.

It more particularly applies to the transmission network using multi-line cables, such as e.g. local or non-local networks, which permit data transmissions (e.g. the networks known under the names STARLAN, ETHERNET, TOKEN RING, etc.), or digital telephone data transmissions (e.g. the RNIS network or digital service integration network). It is known that it is indispensable to be able to connect in branched manner or in series on each network in a simple manner one or more data terminal equipments (DTE) of the data processing and/or telephone type, as a function of the network type considered. Such a data terminal equipment is also known as a terminal or a station.

2. Discussion of the Background

A male connector making it possible to connect, by means of the lines of a communications cable, a data processing and/or telephone terminal to a network by inserting the male connector in a female connector having connecting terminals connected to said network, is e.g. described in European patent application 366556, filed on Oct. 26, 1989. The latter more specifically describes a universal connection system for connecting a processing terminal to a data transmission network. This universal system comprises a male connector and a female connector. The male connector in particular has a parallelepipedic insulating support with two lateral faces, an upper face, a lower face, a front face and a rear face, and connecting terminals partly embedded in the support and issuing onto one of the upper or lower faces. These terminals are connected to the lines of a communications cable surrounded by an insulating envelope and entering into the support by its rear face. The connecting terminals of the male connector respectively come into contact by sliding with the corresponding terminals of a female connector. These female connector terminals are located in a case and are respectively connected to the lines of a communications network. The contacts between the terminals of the male connector and the female connector are established during the insertion of the male connector into the insertion window formed in a front face of the female connector case. This insertion window has edges, which are respectively parallel to the faces of the insulating support of the male connector.

The insulating support of the male connector described in said patent application also comprises a rigid elastic tongue, rendered integral with the support in the vicinity of a face adjacent to the front face of the connector and opposite to the face by which the connecting terminals of the male connector pass out or issue. This tongue is joined to the support by a planar base, which is wider than the tongue. This tongue and this base are inclined and engage in a corresponding recess of the front face of the case, adjacent to the insertion window. The base connecting the tongue to the support has a transverse locking shoulder, so that during the insertion of the male connector in the female connector, the tongue and the base are progessively turned down towards the lower face of the support, by the bearing and sliding of said base on the edges of the recess adjacent to the window of the case. At the end of insertion, the tongue and the base are moved away from the support in order to lock the position of the male connector, by the bearing of the shoulder of the base on an inner wall of the front face of the case. A portion of the tongue remains accessible outside the case.

The advantage of the male connectors of this type is that they have a very reduced size and ensure a good locking of the position of the male connector in the female connector. This advantage can become a disadvantage, e.g. when the cable connected to the male connector is subject to an untimely pulling action, when a person moving in the vicinity of the cable becomes hooked up with it due to carelessness, thus leading to the probable dropping of the apparatus or terminal connected to the said cable with significant risks of the female connector being pulled out.

SUMMARY OF THE INVENTION

The object of the invention is to obviate this disadvantage and more particularly to provide a male connector for a telephone and/or data processing communications network of the type described hereinbefore which, in the case of an untimely pulling action on the cable connecting the male connector to the apparatus when said connector is engaged in the female connector, facilitates its disconnection without any risk of the apparatus and terminal connected to the cable dropping and without any risk of the female connector being pulled out.

The invention relates to a male connector for a telephone and/or data processing communications network comprising a parallelepipedic insulating support having two lateral faces, an upper face, a lower face, a front face and a rear face, connecting terminals partly embedded in the support and issuing onto the upper face, said terminals being connected to lines of a communications cable surrounded by an insulating envelope and entering the support by its rear face, the connecting terminals of the male connector respectively coming into contact by sliding with the corresponding terminals of a female connector, located in a case and respectively connected to lines of a communications network, during the insertion of the male connector into at least one insertion window formed in a front face of the case and having edges respectively parallel to the upper, lower and lateral faces of the said support, the latter also comprising a rigid elastic tongue rendered integral with the support in the vicinity of its lower and front faces by a planar base which is wider than the tongue, said tongue and said base being inclined with respect to the lower face and engaging in a corresponding recess of the front face of the case, adjacent to the window, the base having a transverse locking shoulder in such a way that during the insertion of the male connector the tongue and the base are progressively turned down towards the lower face of the support by the bearing and sliding of said base on the edges of said recess and that at the end of insertion the tongue and the base move away from the lower face of the support in order to lock the position of the male connector by the bearing of said shoulder on an inner wall of said front face of the case, a portion of the tongue being accessible outside the case following the insertion of the male connector, characterized in that it also comprises, on the side of the lower face of the support, a slide bolt sliding along said lower face, between the front and rear faces, and engaging beneath said tongue portion, said slide bolt being provided with elastic means bearing on guide means connected to the support and causing a return movement of the slide bolt towards the front face of the support, the slide bolt being connected by articulated means to the envelope of the cable, in the vicinity of the rear face of the support, a portion of the insulating envelope of the cable adjacent to the support having means for curving the cable towards the lower face of the support, the slide bolt being drawn towards the rear face of the support in order to release the turn-down movement of the tongue, either during insertion, or after insertion, in the case of pulling on the cable acting on the articulated means, in order to facilitate the disconnection of the male connector and the female connector.

According to another feature of the invention, the connector also comprises a locking U-link straddling the support in the vicinity of the rear face, partly covering the lateral faces and the upper face in order to bear on the ends of the lines of the cable within the support and ensuring the respective contacts between the ends of the lines and the corresponding terminals of the male connector.

According to another feature, the lateral, upper and lower faces of the support are at least partly metallized in the vicinity of the respective contacts between the connecting terminals and the ends of the cable lines, in order to form a shielding sleeve connected to a metal sheath for shielding the cable and able to come into contact with a shielding sleeve surrounding the terminals of the female connector, which is in turn connected to a shielding sleeve of the lines of the network.

BRIEF DESCRIPTION OF THE DRAWINGS

The invention is described in greater detail hereinafter relative to non-limitative embodiments and the attached drawings, wherein show.

DESCRIPTION OF THE PREFERRED EMBODIMENT

Figure 1:
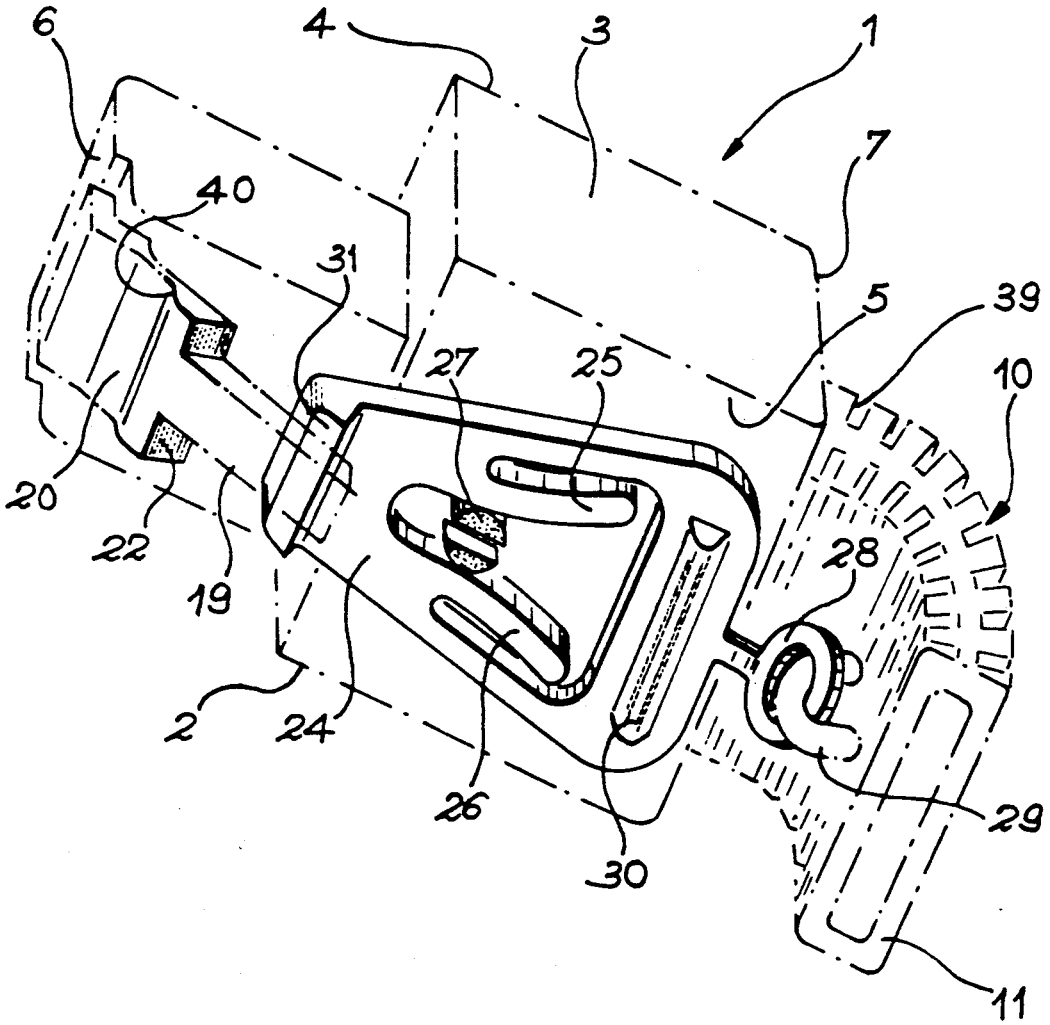
FIG. 1 diagrammatically and in perspective a male connector according to the invention.

The male connector for a telephone and/or data processing communications network according to the invention is diagrammatically shown in perspective in FIG. 1. This connector comprises a parallelepipedic insulating support 1 having two lateral faces 2,3, an upper face 4, a lower face 5, a front face 6 and a rear face 7. As will be shown in greater detail hereinafter relative to FIG. 5, connecting terminals 8 are partly embedded in the support 1 and issue onto the upper face 4 of the support. These terminals are connected to lines 9 of a communications cable 10 surrounded by an insulating envelope 11 and entering the support 1 by its rear face 7. As will be shown in greater detail hereinafter, a portion of the envelope 11 of the cable 10, adjacent to the rear face 7 of the support 1, has means 39 for curving the cable and the sheath surrounding it towards the lower face 5 of the support. These means 39 can be constituted by grooves made in an extra thickness of the envelope 11, in the vicinity of the support 1 and bringing about a return effect on the part of the cable and its envelope towards the lower face 5 of the support 1.

Figure 2:
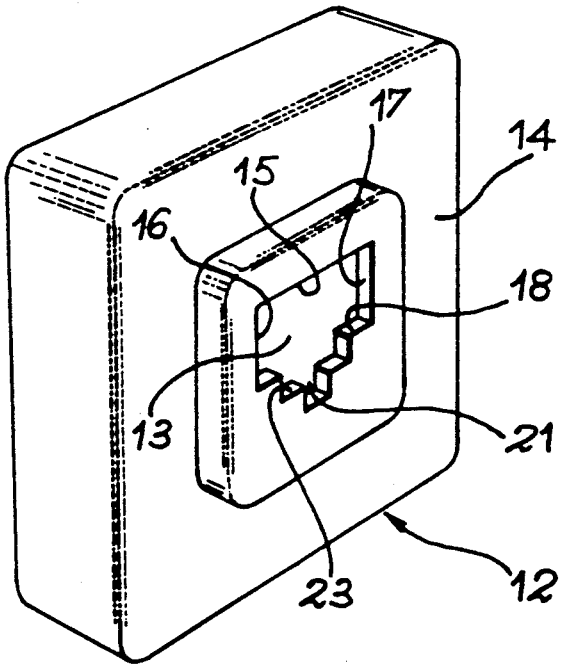
FIG. 2 diagrammatically and in perspective a female connector in which can be inserted the male connector according to the invention.

The connecting terminals 8 of the male connector respectively come into contact by sliding with the corresponding terminals of a female connector. The latter is diagrammatically shown in perspective in FIG. 2. The terminals of the female connector, not shown in said drawing, are enclosed in a case 12 and are respectively connected to lines of a communications network. The case 12 of the female connector has an insertion window 13 formed in a front face 14 of said case. This insertion window permits the insertion of the male connector into the female connector and has edges 15,16,17, 18 respectively parallel to the upper, lower and lateral faces 4,5, 2,3 of the support.

The support 1 shown in FIG. 1 also has a rigid elastic tongue 19, which is joined to the said support in the vicinity of its lower and front faces 5,6 by a base 20, which is wider than the tongue 19. Said tongue and said base are inclined with respect to the lower face 5 of the support and engage in a corresponding recess 21 (FIG. 2) of the front face 14 of the case 12. This recess is adjacent to the window 13. The base 20 has a transverse locking shoulder 22. For facilitating the insertion of the male connector into the female connector, the base 20 and the shoulder 22 can be linked by an inclined surface 40. In the manner shown in the drawing, the shoulder 22 is preferably also inclined.

Figure 3:
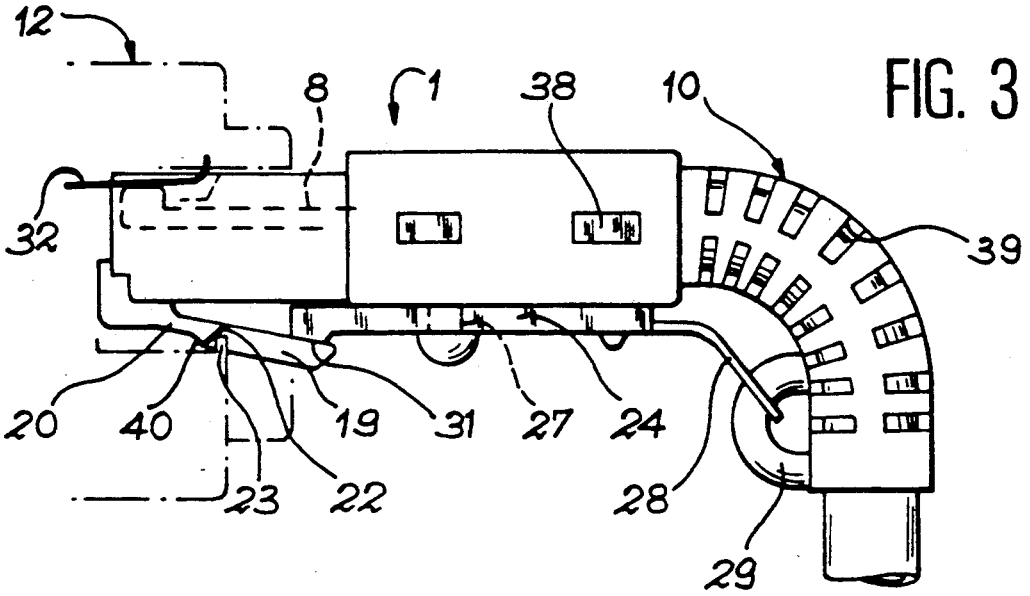
FIG. 3 diagrammatically the male connector according to the invention in the position inserted in the female connector.

During the insertion of the male connector into the window 13 of the female connector, the tongue 19 and the base 20 are progressively turned down towards the lower face 5 of the support 1 by the bearing and sliding of said base and the inclined surface 40 on the edges of the recess 21. At the end of insertion, the tongue and the base move away from the lower face of the support in order to lock the position of the male connector by the bearing of the shoulder 22 on an inner wall of the front face 14 of the case 12. This inner wall is visible at 23 in FIG. 3. As shown in FIG. 3, a portion of the tongue 19 is accessible outside the case 12.

According to the invention and as shown in FIG. 1, the male connector has on the side of the lower face 5 of the support 1, a slide bolt 24 sliding along said lower face 5 between the front face 6 and the rear face 7 of the support. Said slide bolt engages beneath the portion of the tongue 19 which remains outside the front face 14 of the female connector case 12 when the male connector is completely inserted in the said female connector, as shown in FIG. 3.

As shown in FIG. 1, the slide bolt 24 is provided with elastic return means 25,26 bearing on a guide means 27 of the support 1, in order to bring about a return movement of said slide bolt towards the front face 6 of the support, when the slide bolt has been drawn towards the rear face 7. This slide bolt is also connected by articulated means 28,29 to the envelope 11 of the cable 10. The articulated means can e.g. be formed by a ring 28 integral with the slide bolt 24 and by a hook 29 integral with the envelope 11 of the cable 10. The elastic means are constituted by two elastic slides 25,26. The guide means 27 can be formed by a split pin. When the slide bolt is drawn towards the rear face 7 of the support 1, the elastic slides 25,26 move apart. The elasticity of the slides 25,26 and the elasticity of the split pin 27 and the action of the cable curving means 39 permit the urging of the slide bolt 24 towards the front face 6 of the support 1. In the manner shown in FIG. 3, the slide bolt then engages beneath the tongue 19.

The slide bolt 24 is drawn towards the rear face 7 of the support 1, e.g. by the operator's finger pulling on the bulge 30. When insertion is complete, the shoulder 22 bears on the edge 23 of the inner wall of the case 12. The slide bolt can then be released in such a way that the elastic means 25,26 bring it towards the front face 6 of the support 1 and the end 31 engages beneath the tongue 19. FIG. 3 also diagrammatically shows one of the connecting terminals 32 of the female connector contained in the case 12, as well as one of the connecting terminals 8 of the male connector.

Figure 4:
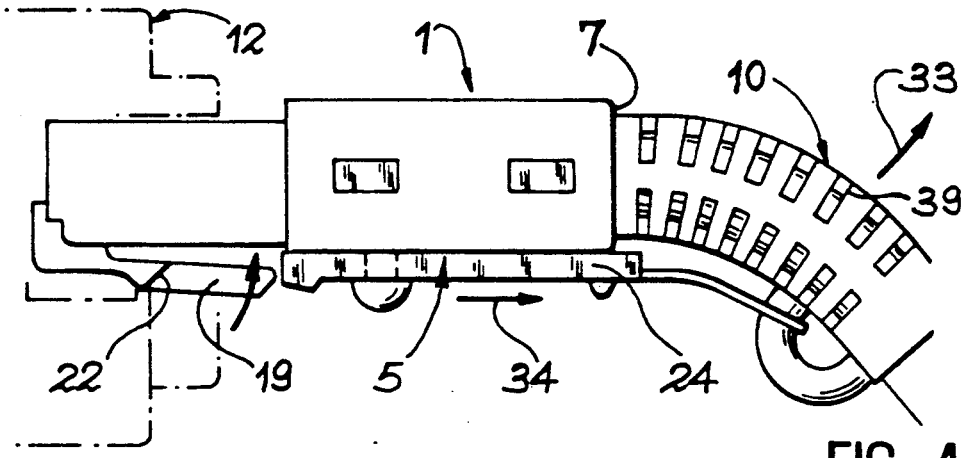
FIG. 4 diagrammatically the male connector according to the invention, in the case of pulling on the cable connecting said connector to an apparatus.

When the male connector is inserted in the female connector, the cable curving or bending means 39, maintain the slide bolt in an inoperative position, the end 31 of said bolt being engaged beneath the tongue 19:

After insertion and as shown in FIG. 4, when a pulling action (indicated by the arrow 33) is exerted on the cable 10, the slide bolt moves towards the rear face 7 of the support 1, as indicated by the arrow 34, due to the action of the articulated means 28,29. The rearward movement of the slide bolt then frees the tongue 19, which can turn down towards the lower face 5 of the support 1. The locked position of the male connector in the female connector which was maintained by means of the shoulder 22 on the wall 23, is then released. The inclined surface 40 aids the release from said locked position. Thus, the disconnection of the male and female connectors is facilitated, which thereby avoids the dropping of the apparatus connected to the cable 10 or the tearing of the female connector out of the case 12.

Figure 5:
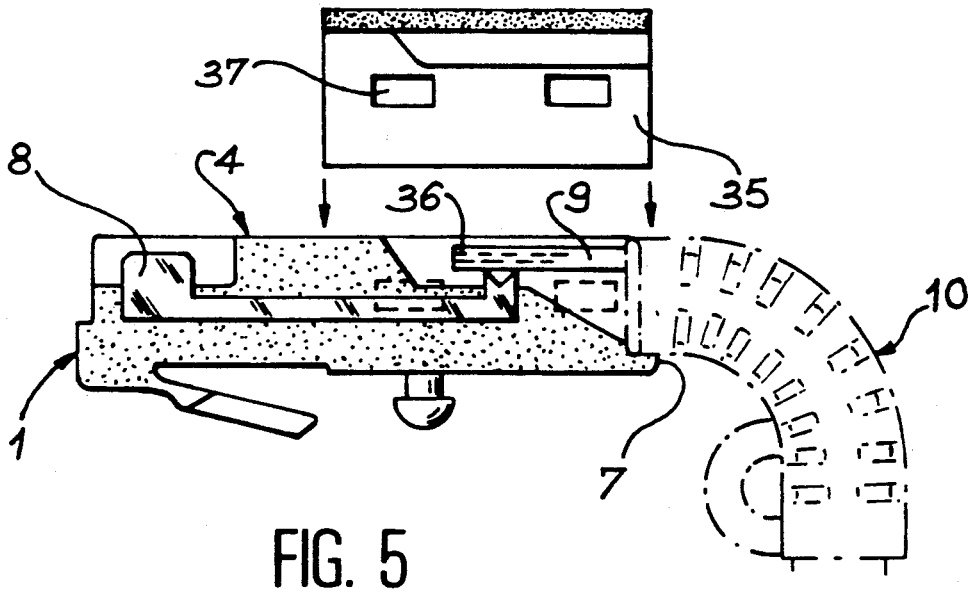
FIG. 5 diagrammatically and in longitudinal section the male connector of the invention.

FIG. 5 shows diagrammatically and in longitudinal section the male connector according to the invention. It is possible to see the connecting terminals 8 thereof embedded in the insulating support 1. The connector has a U-link 35, e.g. made from an insulating material, which encloses the support 1, in the vicinity of its rear face 7. This U-link partly covers the lateral faces 2,3 and the upper face 4 of the support, in order to bear on the end 36 of each line 9 of the communications cable 10 within the support 1. This bearing action makes it possible to ensure the respective contacts between the ends of the lines and the corresponding terminals of the male connector. Each connecting terminal 8, has on the side of the rear face 7 of the support 1, e.g. a pointed shape which, by means of the bearing of the U-link 35 on the line 9, permits the perforation of the insulating material surrounding said line up to the connector surrounded by said insulating material. The terminal and the connector of the line are then in contact. The U-link 35 is maintained on the support 1, e.g. by means of openings 37 formed on the lateral faces of said U-link and which engage on bosses 38 present on the lateral faces of the support 1. The U-link 35 effectively secures the lines 9 of the cable 10.

The lateral faces of the support 1 are at least partly metallized in the vicinity of the respective contacts between the connecting terminals 8 and the ends 36 of the cable lines, in order to form a shielding sleeve, which is connected to a metal sheath for shielding the cable (not shown in this drawing). The shielding can come into contact with a shielding sleeve surrounding the terminals of the female connector within the case 12. The said shielding of the female connector (not shown in these drawings) is itself connected to a shielding sleeve of the network lines.

I claim:

1. Male connector for a telephone and/or data processing communications network comprising a parallelepipedic insulating support (1) having two lateral faces (2,3), an upper face (4), a lower face (5), a front face (6) and a rear face (7), connecting terminals (8) partly embedded in the support (1) and extending onto the upper face (4), said terminals being connected to lines (9) of a communications cable (10) surrounded by an insulating envelope and entering the support (1) by its rear face (7), the connecting terminals (8) of the male connector respectively coming into contact by sliding with corresponding terminals (32) of a female connector located in a case (12) and respectively connected to lines of a communications network during the insertion of the male connector into at least one insertion window (13) formed in a front face (14) of the case said window having edges (15, 16, 17, 18) respectively parallel to the upper, lower and lateral faces of said support, the support also comprising a rigid elastic tongue (19) rendered integral with the support in the vicinity of its lower (5) and front faces (6) by a planar base (20) which is wider than the tongue (19), said tongue and said base being inclined with respect to the lower face (5) and engaging in a corresponding recess (21) of the front face of the case adjacent to the window, the base (20) having a transverse locking shoulder (22) such that during the insertion of the male connector the tongue (19) and the base (20) are progressively turned down towards the lower face (5) of the support by the bearing and sliding of said base on the edges of said recess (21) and that at the end of insertion the tongue and the base move away from the lower face of the support in order to lock the male connector to the female connector by the bearing of said shoulder (22) on an inner wall (23) of said front face of the case (12), a portion of the tongue (19) being accessible outside the case following the insertion of the male connector, said male connector also comprising, on the lower face (5) of the support, a slide bolt (24) sliding along said lower face, between the front (6) and rear faces (7), and engaging beneath said tongue (19) portion, said slide bolt being provided with elastic means (25, 26) bearing on guide means (27) connected to the support (1) and causing a return movement of the slide bolt towards the front face of the support, the slide bolt being connected by articulated means (28, 29) to the envelope (10) of the cable, in the vicinity of the rear face (7) of the support, a portion of the insulating envelope (11) of the cable (10) adjacent to the support (1) having means (39) for curving the cable towards the lower face (5) of the support, the slide bolt being drawn towards the rear face of the support in order to release the turn-down movement of the tongue, either during insertion, or after insertion, when pulling on the cable (10) which acts on the articulated means (28, 29) in order to facilitate the disconnection of the male connector from the female connector.

2. Connector according to claim 1, further comprising a locking U-link (35) straddling the support (1) in the vicinity of the rear face (7), partly covering the lateral faces (23) and the upper face (4) in order to bear on ends (36) of the lines (9) of the cable (10) within the support and ensuring contact between the ends (36) of the lines and the corresponding terminals (8) of the male connector.

3. Connector according to claim 1, wherein the lateral faces (2, 3), upper face (4) and lower face (5) of the support are at least partly metallized in the vicinity of contact between the connecting terminals of the male connector and the ends (36) of the cable lines in order to form a shielding sleeve connected to a metal sheath for shielding the cable, said shielding sleeve of the male connector being able to come into contact with a shielding sleeve surrounding the terminals of the female connector, which is itself connected to a shielding sheath of the network lines.

* * * * *